US011003125B2

(12) United States Patent
Feng et al.

(10) Patent No.: US 11,003,125 B2
(45) Date of Patent: May 11, 2021

(54) PROCESSING BOX

(71) Applicant: ZHUHAI FAST IMAGE PRODUCTS CO., LTD., Guangdong (CN)

(72) Inventors: Jiebin Feng, Zhuhai (CN); Le Huang, Zhuhai (CN); Xueliang Shi, Zhuhai (CN)

(73) Assignee: ZHUHAI FAST IMAGE PRODUCTS CO., LTD., Guangdong (CN)

( * ) Notice: Subject to any disclaimer, the term of this patent is extended or adjusted under 35 U.S.C. 154(b) by 0 days.

(21) Appl. No.: 16/954,447

(22) PCT Filed: Jan. 25, 2019

(86) PCT No.: PCT/CN2019/073171
§ 371 (c)(1),
(2) Date: Jun. 16, 2020

(87) PCT Pub. No.: WO2019/129305
PCT Pub. Date: Jul. 4, 2019

(65) Prior Publication Data

US 2021/0088957 A1 Mar. 25, 2021

(30) Foreign Application Priority Data

Dec. 26, 2017 (CN) ..... 201711432390.X

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01); *G03G 21/1842* (2013.01)

(58) Field of Classification Search
CPC . G03G 15/757; G03G 21/186; G03G 21/1842
See application file for complete search history.

(56) References Cited

U.S. PATENT DOCUMENTS 5,052,671 A * 10/1991 Matsuo ..... B65H 1/04 271/9.06
2003/0185584 A1* 10/2003 Hirose ..... G03G 21/1814 399/92

(Continued)

FOREIGN PATENT DOCUMENTS

CN 102880034 A 1/2013
CN 105807595 A 7/2016

(Continued)

OTHER PUBLICATIONS

PCT International Search Report, PCT/CN2019/073171, dated Mar. 13, 2019, 17 Pages.

*Primary Examiner* — Francis C Gray
(74) *Attorney, Agent, or Firm* — Fenwick & West LLP

(57) ABSTRACT

A processing box, comprising a housing, the housing comprising two end plates located at two opposite ends; and deflectable deflection sliders, being provided at the bottom of the housing, the deflection sliders being provided on the housing by means of a rotating shaft, and being able to rotate on the surface of the bottom wall of the housing. When the processing box is mounted in an image forming device by means of a mounting bracket on the image forming device, the deflection sliders cooperate with a guide portion of the mounting bracket and deflect in accordance with the guide portion of the mounting bracket, so that the processing box can be deflected firstly relative to the image forming device and then be placed properly, thereby facilitating the mounting of the processing box.

14 Claims, 7 Drawing Sheets

(56) References Cited

U.S. PATENT DOCUMENTS

| | | | | |
|---|---|---|---|---|
| 2005/0207783 | A1* | 9/2005 | Sugimura | G03G 21/1633 399/111 |
| 2008/0286000 | A1 | 11/2008 | Kimizuka et al. | |
| 2012/0093523 | A1* | 4/2012 | Kamoshida | G03G 21/1875 399/12 |
| 2012/0201567 | A1 | 8/2012 | Toba et al. | |
| 2015/0050045 | A1* | 2/2015 | Sato | G03G 15/6511 399/111 |
| 2017/0108823 | A1 | 4/2017 | Numata et al. | |
| 2017/0300007 | A1* | 10/2017 | Lin | G03G 15/757 |

FOREIGN PATENT DOCUMENTS

| | | | | |
|---|---|---|---|---|
| CN | 106647208 | A | | 5/2017 |
| CN | 206573857 | U | | 10/2017 |
| CN | 208013670 | U | | 10/2018 |
| JP | 06255810 | A | * | 9/1994 |

* cited by examiner

PROCESSING BOX

The present application is the national phase of international application No. PCT/CN2019/073171, titled "PROCESSING BOX", filed on Jan. 25, 2019, which claims the priority to Chinese Patent Application No. 201711432390.X, titled "PROCESSING BOX", filed with the China National Intellectual Property Administration on Dec. 26, 2017, the entire contents of which are incorporated herein by reference.

FIELD

The present application relates to a processing box used in an image forming device.

BACKGROUND

The processing box is a box which is detachably mounted in the host of the image forming device. As an integral unit, the processing box includes a housing, a toner cartridge, a developing roller, and the like. The processing box is detachable with respect to the host of the device, which facilitates the maintenance of the device. When the processing box is being installed in the image forming device, the traditional installation method is vertical or parallel installation, but now processing boxes installed in an inclined manner are also present, such as the processing box disclosed in the Chinese invention patent application No. CN105785739A. By providing an installation guide portion on an end plate of the processing box, the processing box can be installed into the image forming device in an inclined manner.

However, some of the existing image forming devices are provided with an installation frame for guiding the installation of the processing box, and a guide portion is arranged on the installation frame, so that the processing box needs to be installed along the guide portion of the installation frame during installation, which results in that the existing processing box installed in an inclined manner cannot be normally installed in the image forming device, and brings inconvenience to the user.

SUMMARY

An object of the present application is to provide a processing box which can be easily installed into an image forming device.

For the above purpose, the following technical solutions are adopted in the present application.

A processing box includes a housing, and the housing includes two end plates provided at two opposite ends of the housing; a deflectable deflection slider is provided at the bottom of the housing, and the deflection slider is arranged on the housing by a rotation shaft and is rotatable relative to a surface of a bottom wall of the housing.

A processing box detachably installed in the image forming device having a processing box installation frame includes a housing, and the housing includes two end plates provided at two opposite ends of the housing; a deflectable deflection slider is provided at the bottom of the housing, and the deflection slider is arranged on the housing by a rotation shaft and is rotatable relative to a surface of a bottom wall of the housing; and the deflection slider cooperates with a guide portion of the processing box installation frame.

More specifically, the deflection slider includes a first deflection slider and a second deflection slider, and the first deflection slider and the second deflection slider are respectively close to the two corresponding end plates.

More specifically, the first deflection slider is arranged on the housing by a pair of rotation shafts and is provided with two strip-shaped through holes in misaligned front-back arrangement, and each of the rotation shafts extends into the corresponding strip-shaped through hole; and the first deflection slider is deflected or aligned with respect to the housing by changing the positions of the rotation shafts in the strip-shaped through holes.

More specifically, the second deflection slider is arranged on the housing by a pair of rotation shafts and is provided with a circular hole and a waist-shaped hole, and the rotation shafts respectively extend into the circular hole and the waist-shaped hole; the second deflection slider is rotatable around the rotation shaft in the circular hole, and the second deflection slider is deflected or aligned with respect to the housing by changing the position of the rotation shaft in the waist-shaped hole.

More specifically, a first guide portion and a second guide portion cooperating with the top of a side wall of the installation frame of the image forming device are arranged on the bottom of the first deflection slider and the bottom of the second deflection slider, respectively.

More specifically, at least one of the two end plates is provided with a linkage assembly, and the linkage assembly includes

- a positioning rod hinged to the end plate, wherein a free end of the positioning rod is close to or away from the end plate as the positioning rod rotates, and the positioning rod is provided with an abutting portion protruding in a direction close to the end plate; and
- a swing rod capable of swinging up and down arranged on the end plate, wherein the swing rod is provided with a position-limiting portion, when the swing rod pops up, the position-limiting portion is in an inward rotation path of the positioning rod, and a rotation axis of the positioning rod is perpendicular to a rotation axis of the swing rod.

More specifically, the rotation axis of the swing rod is parallel to a center line of the toner cartridge.

More specifically, a positioning rod elastic member for providing a force for the positioning rod to rotate outward is provided between the positioning rod and the end plate.

More specifically, a swing rod elastic member for providing a force for the swing rod to rotate upward is provided between the swing rod and the end plate.

More specifically, a first positioning rib and a second positioning rib are provided on an outer surface of a side of the processing box housing opposite to where the deflection slider is provided. The first positioning rib is located at the front of the processing box, and the second positioning rib is located at the rear of the processing box.

More specifically, a protrusion protruding outward in a direction parallel to an axis of the toner cartridge is provided on a toner cartridge installation plate of the processing box, and an upper surface of the protrusion is two intersecting bevels.

More specifically, at least one tension spring is provided between the toner cartridge installation plate and the end plate of the processing box. The tension spring is located beside the toner cartridge. One end of the tension spring is connected to the toner cartridge installation plate, and the other end of the tension spring is connected to the end plate.

More specifically, the toner cartridge is provided with a transmission gear, the transmission gear is engaged with a developing roller gear provided on the developing roller, and a teeth number of the transmission gear is 56 to 58.

More specifically, a transmission ratio of the transmission gear to the developing roller gear is 1.8 to 2.

More specifically, the transmission gear is provided at an end of the toner cartridge where a drive coupling is provided.

As can be seen from the above technical solutions, the processing box according to the present application is provided with the deflectable deflection slider at the bottom of the housing, so that when the processing box is installed into the image forming device through the installation frame of the image forming device, the deflection slider cooperates with the guide portion of the installation frame and deflects along the guide portion of the installation frame, and the housing does not need to cooperate with the installation frame, and the processing box can thereby be installed into the image forming device in a tilted state under the action of the linkage assembly; and as the processing box further enters the image forming device in the installation frame and the installation is about to be completed, the processing box is aligned in the image forming device, and the deflection slider rotates to a state of being aligned with the processing box along with the aligning of the processing box, finishing the installation of the processing box. That is, the installation process according to the present application of first deflecting the processing box relative to the image forming device and then aligning it makes the installation of the processing box more convenient.

BRIEF DESCRIPTION OF THE DRAWINGS

In order to more clearly illustrate embodiments of the present application, the drawings to be used in the embodiments or the conventional technology are briefly described below. Apparently, the drawings in the following description only show some embodiments of the present application, and other drawings may be obtained by those skilled in the art from the drawings without any creative work.

DETAILED DESCRIPTION OF THE EMBODIMENTS

The technical solutions in the embodiments of the present application will be described clearly and completely hereinafter in conjunction with the drawings in the embodiments of the present application. The described embodiments are only a part of the embodiments of the present application, rather than all embodiments. Any other embodiments obtained by those skilled in the art based on the embodiments of the present application without any creative work fall within the protection scope of the present application.

Figure 1:
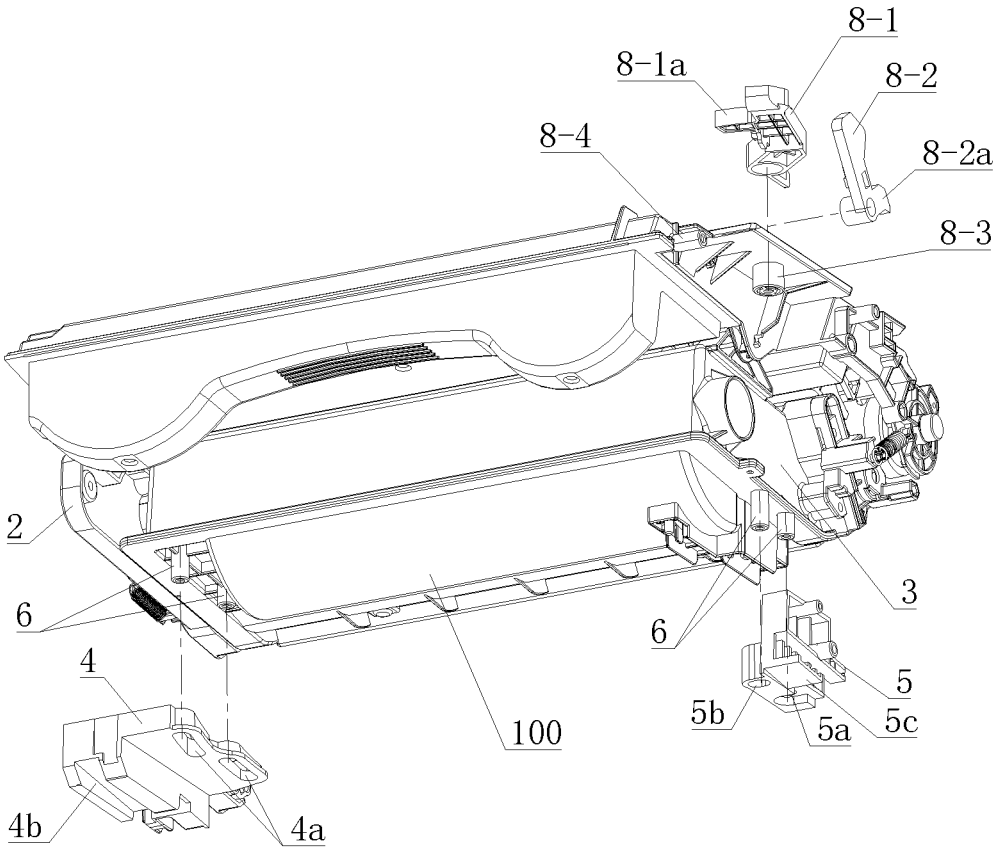
FIG. 1 is a schematic structural view of a processing box according to an embodiment of the present application.
Figure 2:
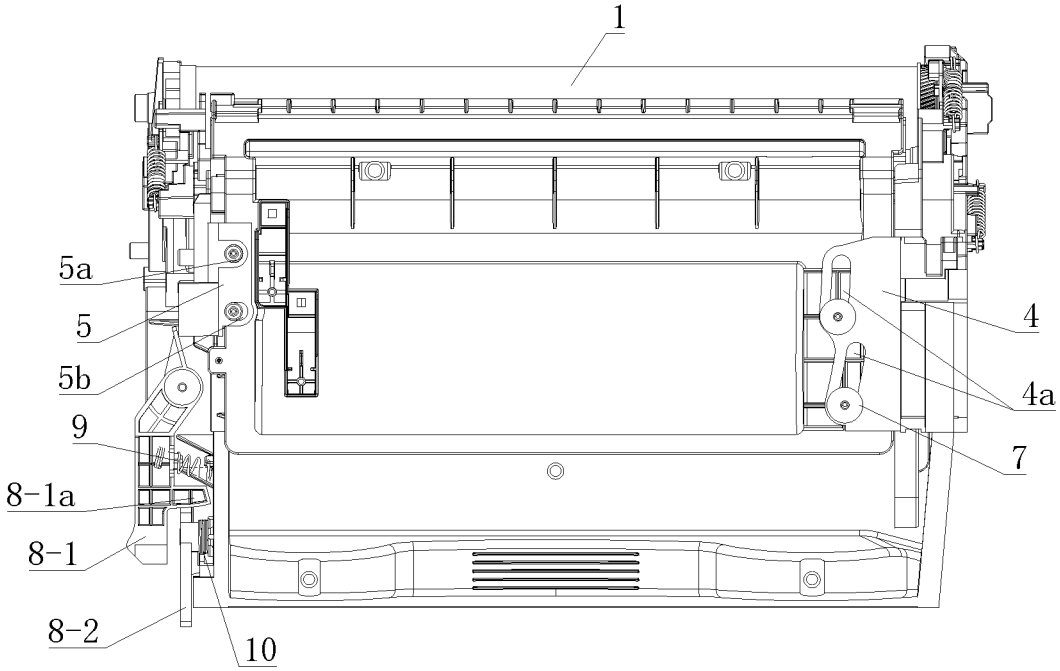
FIG. 2 is a bottom view of the processing box according to the embodiment of the present application.
Figure 3:
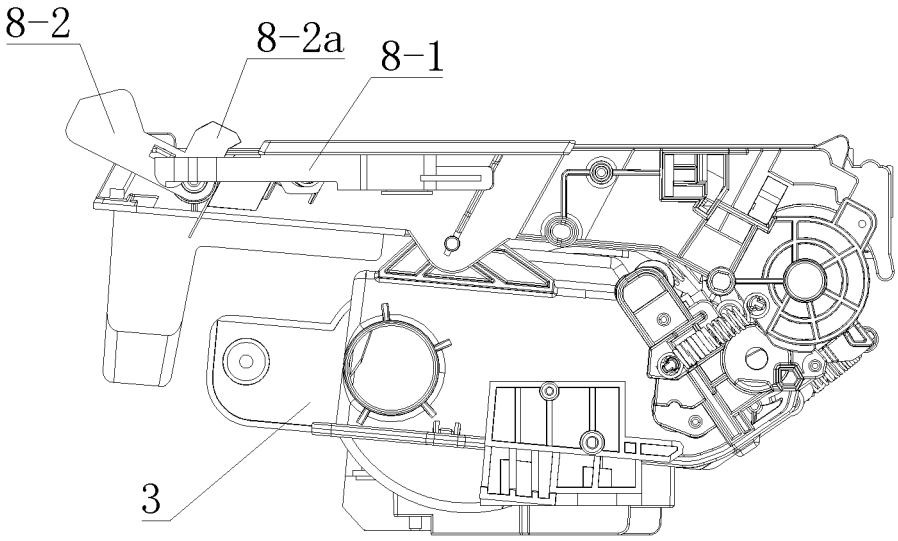
FIG. 3 is a right view of FIG. 1.

As shown in FIGS. 1, 2 and 3, a processing box according to the present embodiment includes a housing 1 in which components such as a toner cartridge and a developing roller are provided. A first end plate 2 and a second end plate 3 are provided at two ends of the housing 1, respectively. The first end plate 2 and the second end plate 3 are located at two ends of the toner cartridge in an axial direction. The first and second end plates may be a part of the housing or members independent of the housing and installed on a side wall of the housing.

A first deflection slider 4 and a second deflection slider 5 are provided at the bottom of the housing 1. The first deflection slider 4 and the second deflection slider 5 are located at two ends of the bottom of the housing 1 respectively, and are deflectable with respect to the housing 1, that is, each center line of the first deflection slider 4 and the second deflection slider 5 projected on the bottom surface of the housing may form an angle with the center line of the processing box projected on the bottom surface of the housing. The first deflection slider 4 and the second deflection slider 5 are arranged on the housing 1 by rotation shafts 6. Each of the rotation shafts 6 in the present embodiment is a protruding post fixed to the bottom of the housing 1. An end portion of each rotation shaft 6 is provided with a threaded hole. The first deflection slider 4 and the second deflection slider 5 are installed on the housing 1 through the cooperation of screws 7 and the threaded holes at the end portions of the rotation shafts 6.

In the present embodiment, the first deflection slider 4 is provided on the housing 1 by a pair of rotation shafts 6. The first deflection slider 4 is provided with two strip-shaped through holes 4*a* in misaligned front-back arrangement, and each of the pair of the rotation shafts 6 extends into the corresponding strip-shaped through hole 4*a*. When subjected to an external force, the first deflection slider 4 can slide on the bottom surface of the housing 1 to be deflected or aligned with respect to the housing 1 by changing positions of the rotation shafts 6 in the strip-shaped through holes 4*a*, and the rotation range of the first deflection slider 4 is be defined by setting angles and lengths of the strip-shaped through holes 4*a*. A first guide portion 4*b* is arranged on the bottom of the first deflection slider 4, and the structure of the first guide portion 4*b* corresponds to the structure of a side wall of the installation frame of the image forming device. The first guide portion 4*b* in the present embodiment is a groove which can accommodate a top flange of the side wall of the installation frame.

In the present embodiment, the second deflection slider 5 is provided on the housing by a pair of rotation shafts 6. The second deflection slider 5 is provided with a round hole 5*a* and a waist-shaped hole 5*b*, and the two rotation shafts 6 extend into the round hole 5*a* and the waist-shaped hole 5*b*, respectively. When subjected to an external force, the second deflection slider 5 can rotate around the rotation shaft 6 in the circular hole 5*a*, and the position of the rotation shaft 6 in the waist-shaped hole 5*b* is changed, so that the second deflection slider 5 slides on the bottom surface of the housing 1 to be deflected or aligned with respect to the housing 1, and the rotation range of the second deflection slider 5 is be defined by the length of the waist-shaped hole 5*b*. A second guide portion 5*c* is arranged on the bottom of the second deflection slider 5, and the structure of the second guide portion 5*c* corresponds to the structure of the side wall of the installation frame of the image forming device. The second guide portion 5*c* in the present embodiment is a plane extending inward from a side edge of the second deflection slider 5, which can cooperate with a top surface of the side wall of the installation frame.

A linkage assembly 8 is provided on the first end plate 2 or the second end plate 3, and an arrangement position of the linkage assembly 8 corresponds to the position of a pressing member in the image forming device. In the present embodiment, the linkage assembly 8 is provided on the second end plate 3, and the first end plate 2 is an end plate on a side where a driving force receiving assembly of the processing box is located. The linkage assembly 8 includes a positioning rod 8-1 and a swing rod 8-2. For ease of description, the front and rear are defined according to the direction in which the processing box is installed into the image forming device, and the positioning rod 8-1 is located in front of the swing rod 8-2.

The positioning rod 8-1 is arranged on the second end plate 3 by a positioning rod rotation shaft 8-3, and the swing rod 8-2 is arranged on the second end plate 3 by a swing rod rotation shaft 8-4. The center line of the swing rod rotation shaft 8-4 is parallel to the center line of the toner cartridge, and the center line of the positioning rod rotation shaft 8-3 is perpendicular to the center line of the swing rod rotation shaft 8-4, that is, the rotation axis of the positioning rod 8-1 is perpendicular to the rotation axis of the swing rod 8-2. The positioning rod 8-1 is rotatable in a horizontal plane around the positioning rod rotation shaft 8-3, and the swing rod 8-2 is rotatable in a vertical plane around the swing rod rotation shaft 8-4. A positioning rod elastic member 9 is provided between the positioning rod 8-1 and the second end plate 2. The positioning rod elastic member 9 provides a force for the positioning rod 8-1 to rotate outward. When not subjected to other external forces, the positioning rod 8-1 pops out under the elastic force of the positioning rod elastic member 9, that is, a free end of the positioning rod 8-1 gets away from the second end plate 2. A swing rod elastic member 10 is provided between the swing rod 8-2 and the second end plate 2. The swing rod elastic member 10 provides a force for the swing rod 8-2 to rotate upward. When not subjected to other external forces, the swing rod 8-2 pops up under the elastic force of the swing rod elastic member 10, that is, a free end of the swing rod 8-2 extends upward out of the housing 1. The positioning rod 8-1 is provided with an abutting portion 8-*la* protruding in a direction close to the second end plate 3, and a position-limiting portion 8-2*a* is provided at an end of the swing rod 8-2 opposite to the free end of the swing rod 8-2. The position of the abutting portion 8-*la* corresponds to the position of the position-limiting portion 8-2*a*. When the swing rod 8-2 extends upward, the position-limiting portion 8-2*a* is located in an inward rotation path of the positioning rod 8-1 (that is, in a path along which the positioning rod 8-1 moves toward the second end plate 3), and the abutting portion 8-*la* abuts against the position-limiting portion 8-2*a*, so that the positioning rod 8-1 is prevented from rotating toward the second end plate 3, which allows the processing box to be installed into the image forming device in a tilted state.

The installation process of the processing box of the present application is described hereinafter in combination with FIGS. 4 to 11.

Figure 4:
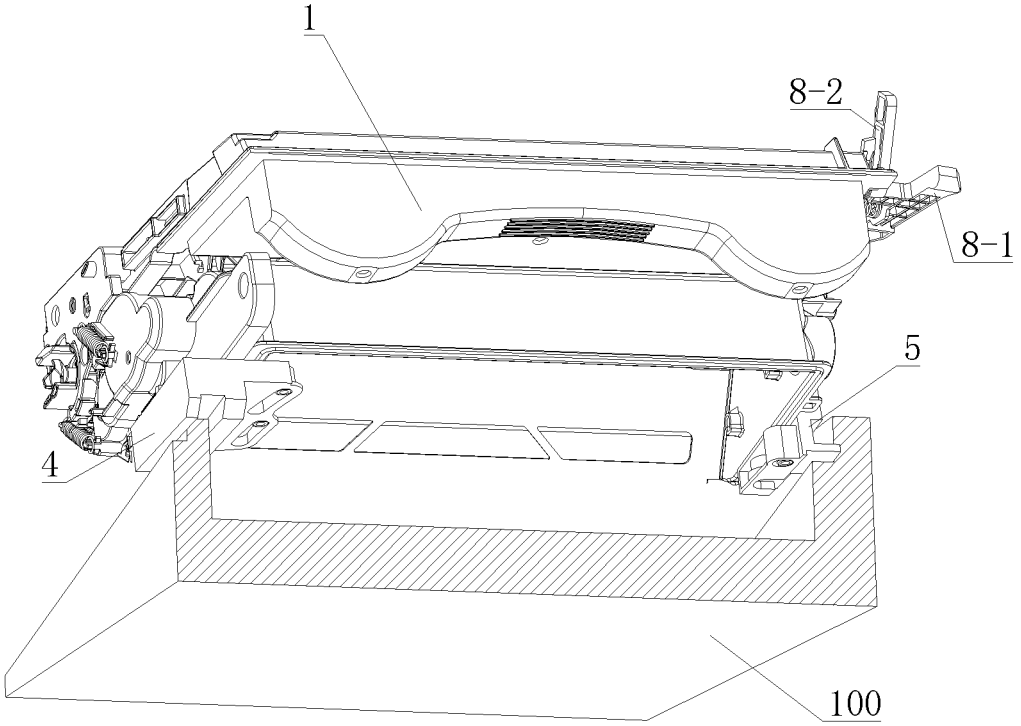
FIG. 4 is a schematic view of the processing box when the processing box is to be installed into an image forming device.
Figure 5:
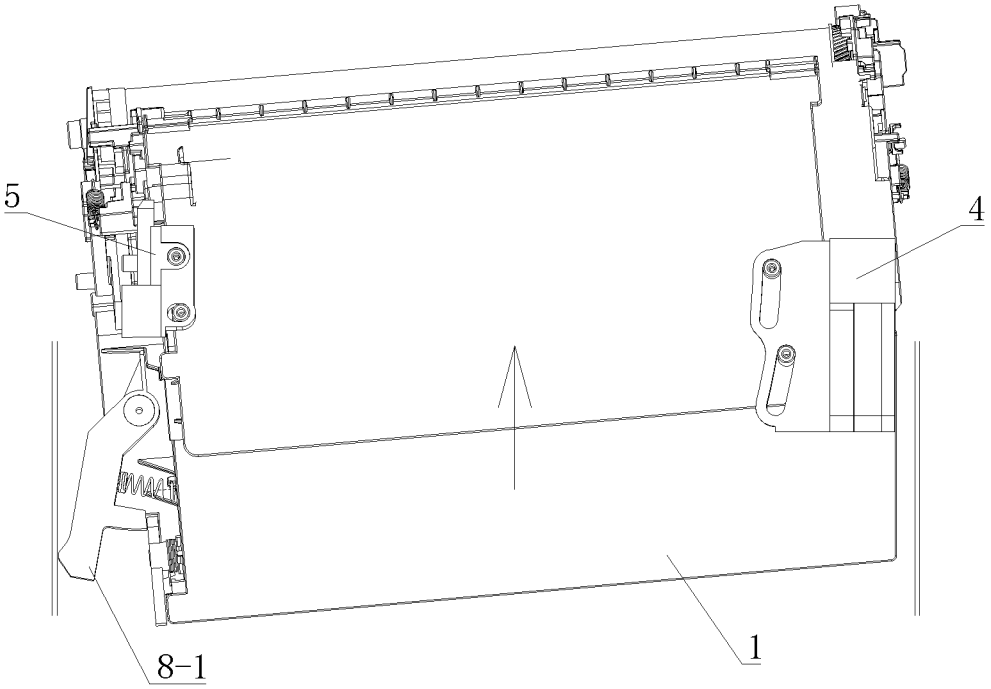
FIG. 5 is a schematic view showing positions of a first deflection slider and a second deflection slider when the processing box is to be installed into the image forming device.
Figure 6:
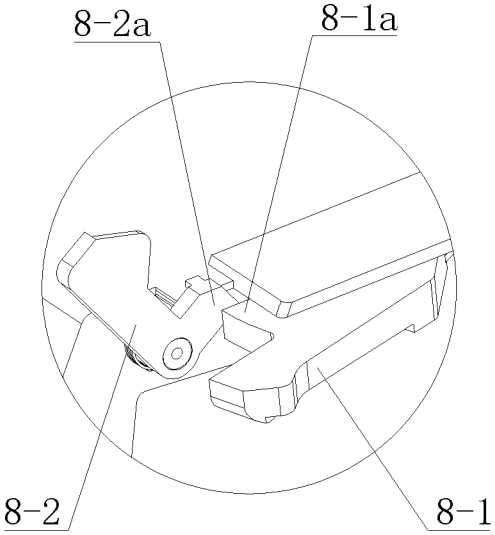
FIG. 6 is a schematic view showing positions of a positioning rod and a swing rod when the processing box is to be installed into the image forming device.

Referring to FIGS. 4, 5 and 6, before the processing box is installed in the installation frame 100 and enters the image forming device, the positioning rod 8-1 pops out under the action of the positioning rod elastic member 9, and the swing rod 8-2 pops up under the action of the swing rod elastic member 10; at this time, since the position-limiting portion 8-2*a* of the swing rod 8-2 is located in the inward rotation path of the positioning rod 8-1, the abutting portion 8-*la* of the positioning rod 8-1 abuts against the position-limiting portion 8-2*a* of the swing rod 8-2, so that the positioning rod 8-1 cannot rotate inward, and at this time, the first deflection slider 4 and the second deflection slider 5 are in initial positions deflected relative to the housing 1 and cooperate with the guide portion of the installation frame 100.

When the processing box enters the image forming device together with the installation frame 100 and the positioning rod 8-1 contacts the inner wall of the image forming device, the processing box is deflected with respect to the installation frame by the first deflection slider 4 and the second deflection slider 5 (at this time, a side of the processing box close to the installation operator is deflected away from the positioning rod 8-1), which is equivalent to entering the image forming device in an inclined manner. However, since both the first deflection slider 4 and the second deflection slider 5 are deflectable with respect to the housing 1, the processing box can still adapt to the guide portion of the installation frame 100.

Figure 7:
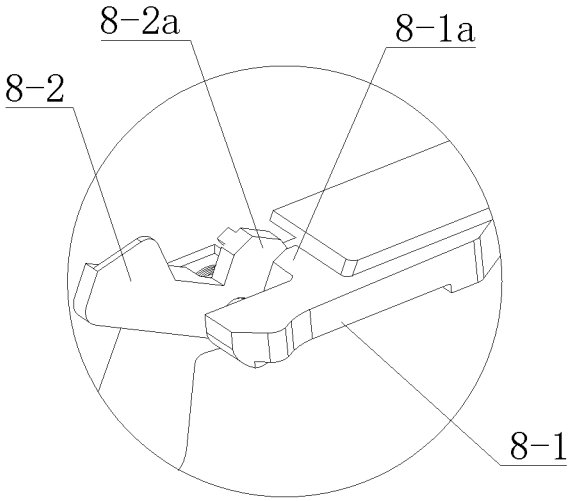
FIG. 7 is a schematic view showing the positions of the positioning rod and the swing rod after the processing box is installed into the image forming device.
Figure 8:
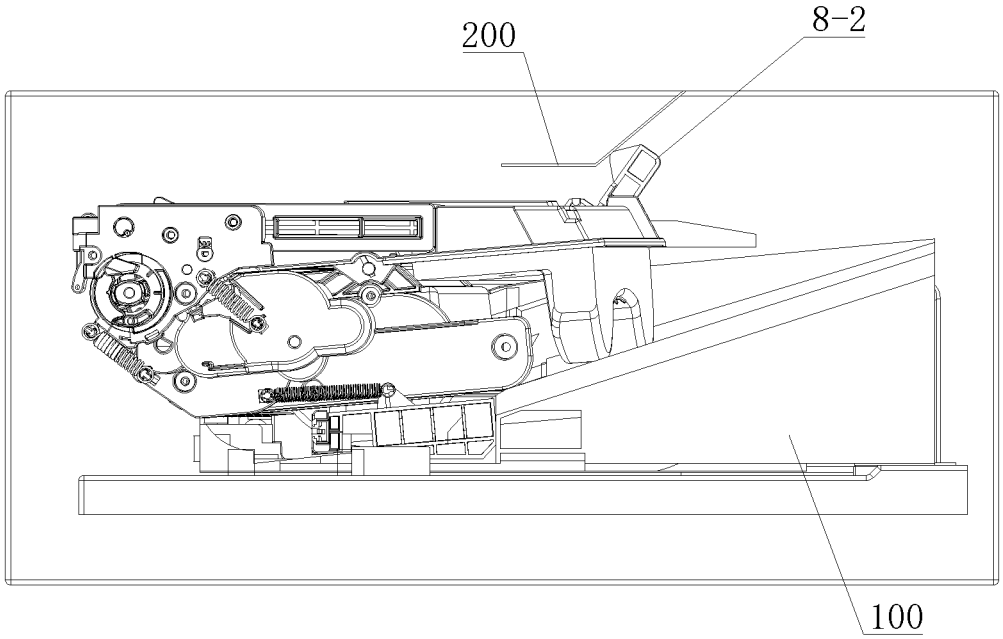
FIG. 8 is a schematic view showing the position of the swing rod when the processing box is to be installed into the image forming device.
Figure 9:
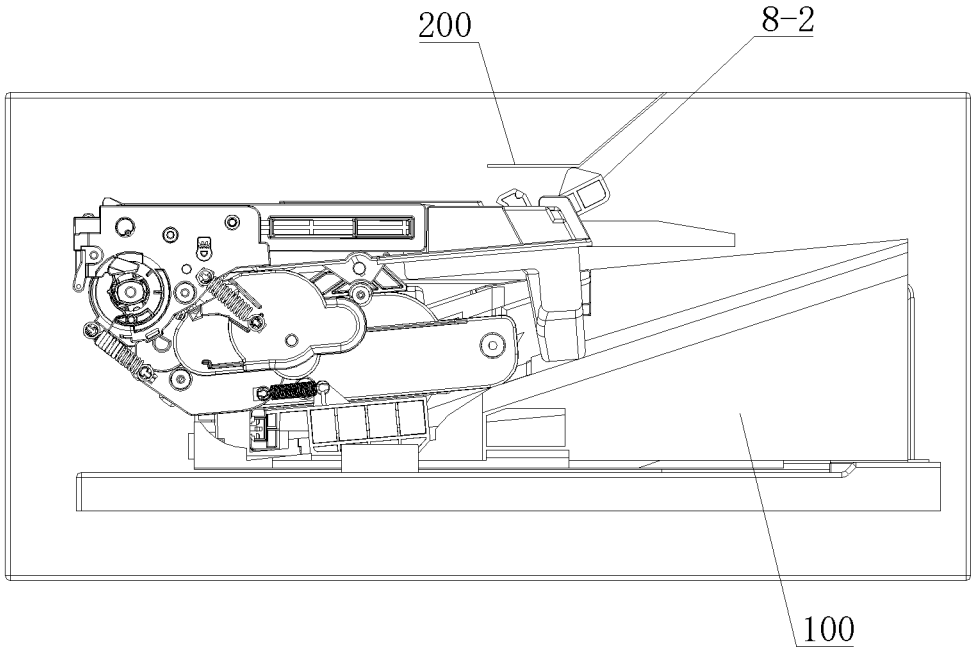
FIG. 9 is a schematic view showing the position of the swing rod after the processing box is installed into the image forming device.

Referring to FIGS. 7, 8, and 9, during the further installation process of the processing box into the image forming device via the installation frame 100, the top of the swing rod 8-2 is blocked by a pressing member 200 (or inner wall) in the image forming device, and at this time, the pressure exerted by the pressing member 200 on the swing rod 8-2 allows the swing rod 8-2 to rotate downward against the elastic force of the swing rod elastic member 10, thereby moving the position-limiting portion 8-2 away from the inward rotation path of the positioning rod 8-1. After the stopper 8-2 is moved away from the inward rotation path of the positioning rod 8-1, the positioning rod 8-1 is flattened against the second end plate 3 under the pressure of the inner wall of the image forming device, and the position of the processing box is aligned with respect to the installation frame and the image forming device.

Figure 10:
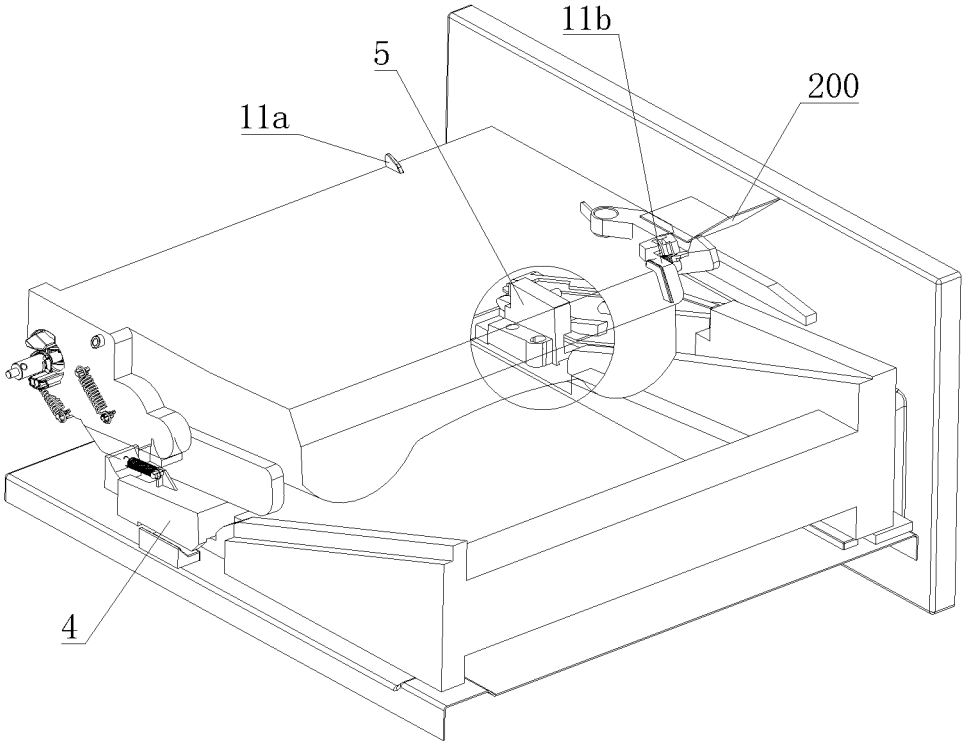
FIG. 10 is a schematic view of the processing box after the processing box is installed into the image forming device.
Figure 11:
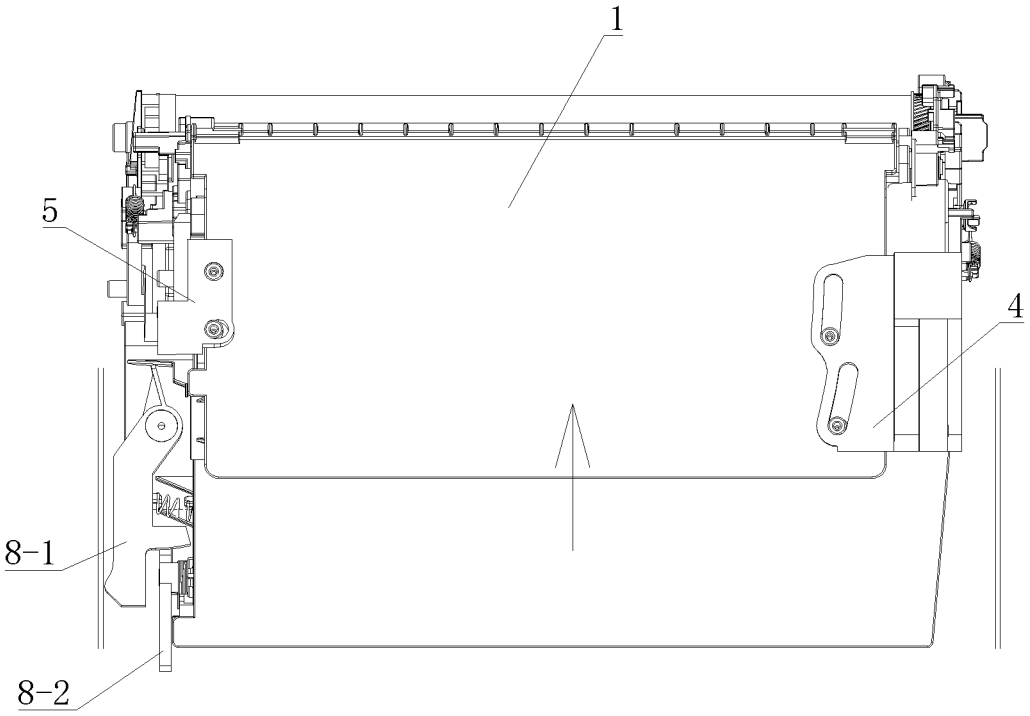
FIG. 11 is a schematic view showing positions of the first deflection slider and the second deflection slider after the processing box is installed into the image forming device.

Referring to FIGS. 10 and 11, during the alignment process of the processing box, the first deflection slider 4 and the second deflection slider 5 are also aligned with respect to the housing 1 by rotation, finishing the installation. It can be seen from the above that, during the installation process, the first deflection slider 4 and the second deflection slider 5 always support the entire processing box, so that the processing box can be obliquely installed into the image forming device first and can be aligned when the installation is completed, which facilitates the installation of the processing box, and is especially suitable for the processing box having a fixed drive coupling.

Figure 12:
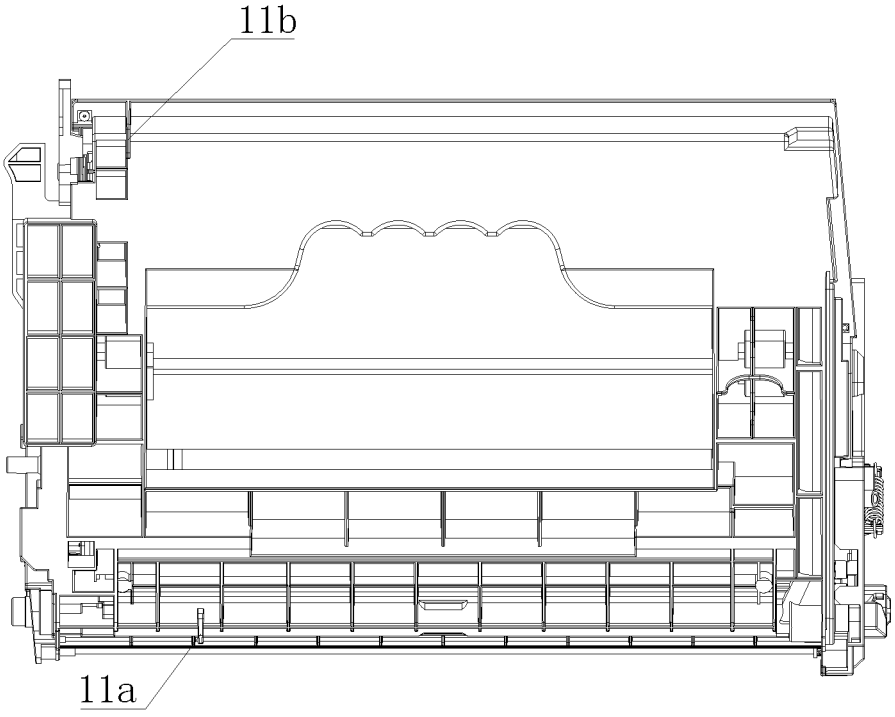
FIG. 12 is a top view of the processing box according to the embodiment of the present application.

As a preferred embodiment of the present application, as shown in FIGS. 10 and 12, a first positioning rib 11*a* and a second positioning rib 11*b* are provided on an outer side surface of the top wall of a waste powder bin of the processing box. The first positioning rib 11*a* and the second positioning rib 11*b* protrude from the outer side surface of the top wall of the waste powder bin. The first positioning rib 11*a* is located at the front of the processing box (the installation direction, as shown by the arrows in FIGS. 5 and 11, of the processing box is defined as front, that is, a direction in which the processing box is away from the installation operator during the installation of the processing box), and the second positioning rib 11*b* is located at the rear of the processing box. During the installation of the processing box, the first positioning rib 11*a* can abut against the inner wall of the image forming device, the first positioning rib 11*a* can prevent the front end of the processing box from tilting upward when the processing box is about to be landed, and make the landing process of the processing box more smooth. When the processing box is removed, the second positioning rib 11*b* can abut against the inner wall of the image forming device, and the second positioning rib 11*b* can prevent the processing box from getting stuck when the processing box is drawn out. Getting stuck makes it difficult to draw out the processing box.

Figure 13:
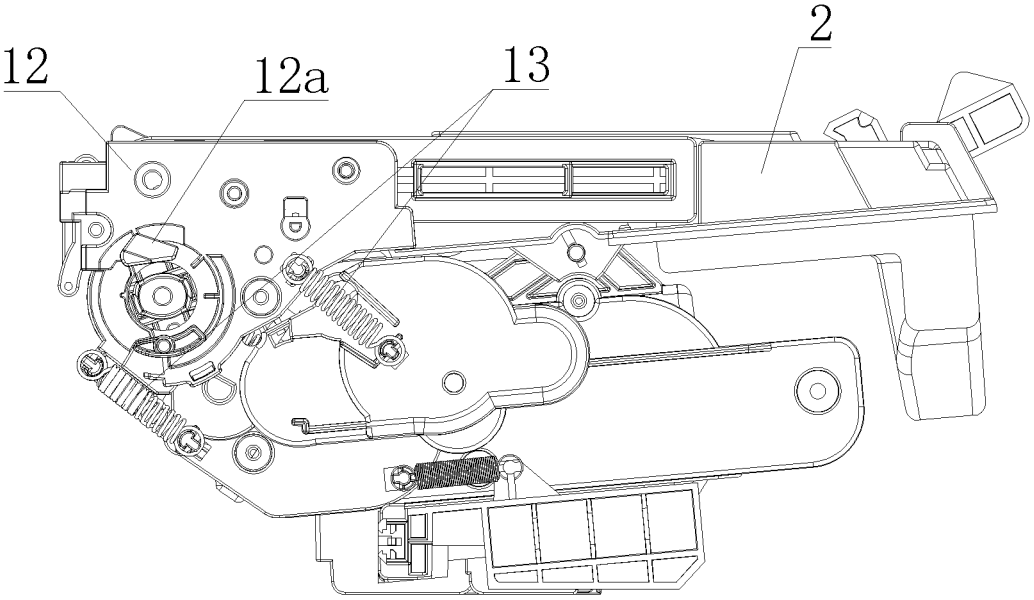
FIG. 13 is a left view of FIG. 1.

More specifically, a protrusion 12*a* protruding from a toner cartridge installation plate 12 in a direction parallel to an axis of the toner cartridge is provided on a toner cartridge installation plate 12, and an upper surface of the protrusion 12*a* is two intersecting bevels (as shown in FIG. 13). The protrusion 12*a* has two intersecting bevels, instead of an upper arc surface of the protrusion in the conventional technology, which can reduce the resistance between the processing box and the pressure spring of the printer when the processing box is being landed and aligned, and can prevent the processing box from moving backward. In addition, in order to avoid affecting print quality due to gear runout, a pair of tension springs 13 is provided between the toner cartridge installation plate 12 and the end plate. The tension springs 13 are located on two sides of the toner cartridge. One end of each tension spring 13 is connected with toner cartridge installation plate 12, and the other end is connected with the end plate. The tension spring 13 can play a role of tightening the toner cartridge installation plate 12 and the end plate, which is conducive to stabilizing the printing quality.

Figure 14:
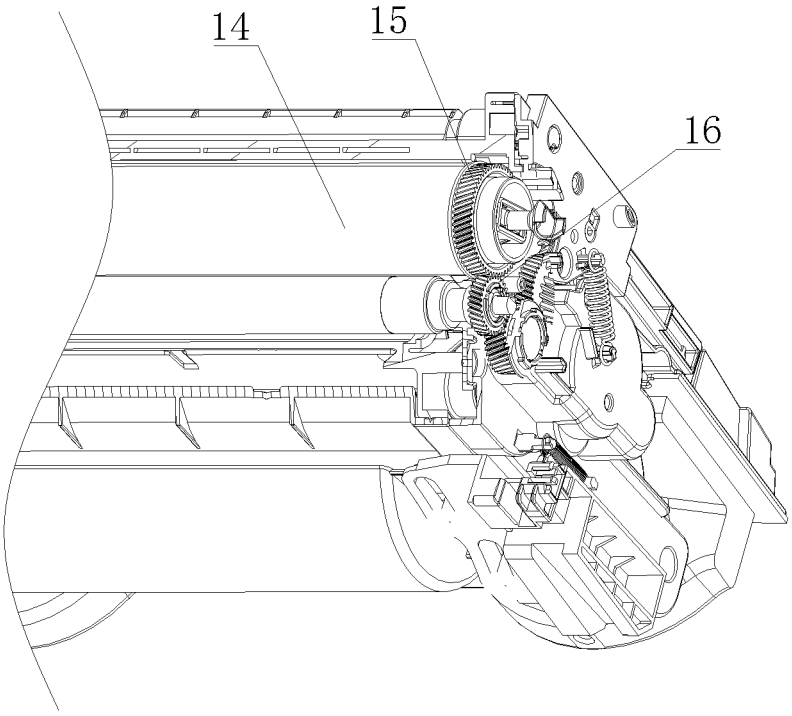
FIG. 14 is a schematic structural view of the processing box according to another embodiment of the present application.

FIG. 14 is a schematic structural view of the processing box according to another embodiment of the present application. As shown in FIG. 14, in the present embodiment, a transmission gear 15 is provided at an end portion of the toner cartridge 14 where the drive coupling is provided. The transmission gear 15 is engaged with a developing roller gear 16 provided at an end portion of the developing roller, thereby transmitting a rotary driving force received by the toner cartridge 14 from a driving head of the image forming device to the developing roller gear 16. The developing roller gear 16 further transmits the rotary driving force to other rotating members such as a powder feeding roller and a stirring frame. The transmission relationship between the developing roller gear and the powder feeding roller gear, the stirring frame gear and other rotating members is designed according to the existing design. By providing the transmission gear 15 engaged with the developing roller gear 16 on the toner cartridge 14, the rotary driving force is transmitted by the transmission gear 15 to the developing roller gear 16, the powder feeding roller and other rotating members, so that the drive coupling provided at the end portion of the powder feeding roller can be removed, and the rotary driving force is transmitted instead by the toner cartridge to other rotating members, thereby solving the problem that two drive couplings are difficult to align with the driving head during the oblique installation of the processing box.

The teeth number of the transmission gear 15 in the present embodiment may be 56 to 58, and the transmission ratio of the transmission gear 15 to the developing roller gear 16 is 1.8 to 2. Preferably, the teeth number of the transmission gear 15 is 57, and the transmission ratio of the transmission gear 15 to the developing roller gear 16 is 1.9. By optimizing the transmission structure, the printing speed and quality are guaranteed.

Based on the above description of the disclosed embodiments, those skilled in the art are capable of implementing or using the present application. Various changes to these embodiments are apparent for those skilled in the art, and general principles defined herein may be implemented in other embodiments without departing from the spirit or scope of the present application. Therefore, the present application is not limited to these embodiments illustrated herein, but should be defined by the broadest scope consistent with the principle and novel features disclosed herein.

The invention claimed is:

1. A processing box detachably installed in an image forming device having a processing box installation frame, comprising a housing, wherein the housing comprises two end plates provided at two opposite ends of the housing; a deflectable deflection slider is provided at the bottom of the housing, and the deflection slider is arranged on the housing by a rotation shaft and is rotatable relative to a surface of a bottom wall of the housing; and the deflection slider is configured to cooperate with a guide portion of the processing box installation frame.

2. The processing box according to claim 1, wherein the deflection slider comprises a first deflection slider and a second deflection slider, the first deflection slider is closer to one end plate than the second deflection slider, and the second deflection slider is closer to the other end plate than the first deflection slider.

3. The processing box according to claim 1, wherein the first deflection slider is arranged on the housing by a pair of rotation shafts and is provided with two strip-shaped through holes in misaligned front-back arrangement, and each of the rotation shafts extends into the corresponding strip-shaped through hole; and the first deflection slider is deflected or aligned with respect to the housing by changing positions of the rotation shafts in the strip-shaped through holes.

4. The processing box according to claim 1, wherein the second deflection slider is arranged on the housing by a pair of rotation shafts and is provided with a circular hole and a waist-shaped hole, and the rotation shafts respectively extend into the circular hole and the waist-shaped hole; and the second deflection slider is rotatable around the rotation shaft in the circular hole, and the second deflection slider is deflected or aligned with respect to the housing by changing the position of the rotation shaft in the waist-shaped hole.

5. The processing box according to claim 2, wherein a first guide portion and a second guide portion cooperating with the top of a side wall of an installation frame of the image forming device are arranged on the bottom of the first deflection slider and the bottom of the second deflection slider, respectively.

6. The processing box according to claim 1, wherein at least one of the two end plates is provided with a linkage assembly, and the linkage assembly comprises a positioning rod hinged to the end plate, wherein a free end of the positioning rod is close to or away from the end plate as the positioning rod rotates, and the positioning rod is provided with an abutting portion protruding in a direction close to the end plate; and a swing rod capable of swinging up and down arranged on the end plate, wherein the swing rod is provided with a position-limiting portion, when the swing rod pops up, the position-limiting portion is in an inward rotation path of the positioning rod, and a rotation axis of the positioning rod is perpendicular to a rotation axis of the swing rod.

7. The processing box according to claim 6, wherein the rotation axis of the swing rod is parallel to a center line of a toner cartridge.

8. The processing box according to claim 6, wherein a positioning rod elastic member for providing a force for the positioning rod to rotate outward is provided between the positioning rod and the end plate.

9. The processing box according to claim 6, wherein a swing rod elastic member for providing a force for the swing rod to rotate upward is provided between the swing rod and the end plate.

10. The processing box according to claim 1, wherein a first positioning rib and a second positioning rib are provided on an outer surface of a side of the processing box housing opposite to where the deflection slider is provided, the first positioning rib is located at the front of the processing box, and the second positioning rib is located at the rear of the processing box.

11. The processing box according to claim 1, wherein a protrusion protruding outward in a direction parallel to an axis of a toner cartridge is provided on a toner cartridge installation plate of the processing box, and an upper surface of the protrusion is two intersecting bevels.

12. The processing box according to claim 1, wherein at least one tension spring is provided between a toner cartridge installation plate and the end plate of the processing box, the at least one tension spring is located beside the toner cartridge, one end of the at least one tension spring is connected to the toner cartridge installation plate, and the other end of the at least one tension spring is connected to the end plate.

13. The processing box according to claim 1, wherein a toner cartridge is provided with a transmission gear, the transmission gear is engaged with a developing roller gear provided on a developing roller, and a teeth number of the transmission gear is 56 to 58.

14. The processing box according to claim 13, wherein a transmission ratio of the transmission gear to the developing roller gear is 1.8 to 2.

* * * * *